US008998522B2

(12) United States Patent
Gueret

(10) Patent No.: US 8,998,522 B2
(45) Date of Patent: Apr. 7, 2015

(54) PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 550 days.

(21) Appl. No.: 13/319,826

(22) PCT Filed: May 12, 2010

(86) PCT No.: PCT/IB2010/052114
§ 371 (c)(1),
(2), (4) Date: Dec. 13, 2011

(87) PCT Pub. No.: WO2010/131214
PCT Pub. Date: Nov. 18, 2010

(65) Prior Publication Data

US 2012/0093566 A1 Apr. 19, 2012

Related U.S. Application Data

(60) Provisional application No. 61/182,849, filed on Jun. 1, 2009.

(30) Foreign Application Priority Data

May 15, 2009 (FR) ..... 09 53257

(51) Int. Cl.
*A46B 11/00* (2006.01)
*A45D 34/04* (2006.01)
(Continued)

(52) U.S. Cl.
CPC ..... *A45D 34/046* (2013.01); *A45D 40/267* (2013.01); *A45D 2200/157* (2013.01); *A46B 9/021* (2013.01); *A46B 13/02* (2013.01); *A46B 2200/1053* (2013.01)

(58) Field of Classification Search
USPC ..... 401/126–130; 15/160, 164
See application file for complete search history.

(56) References Cited

U.S. PATENT DOCUMENTS 3,998,235 A 12/1976 Kingsford
4,744,377 A 5/1988 Dolan, Jr.
(Continued)

FOREIGN PATENT DOCUMENTS

CN 1742644 3/2006
EP 0 922 407 A1 6/1999
(Continued)

OTHER PUBLICATIONS

International Search Report issued in International Application No. PCT/IB2010/052114 dated Sep. 30, 2010.
(Continued)

*Primary Examiner* — David Walczak
(74) *Attorney, Agent, or Firm* — Oliff PLC

(57) ABSTRACT

A packaging and applicator device for applying a composition on the eyelashes and/or the eyebrows, that includes a container defining an inside space containing the composition and including a wiper member; and an applicator having a longitudinal axis and having an applicator member with a twisted-core brush carrying bristles, there being 5 to 55 bristles per turn, the diameter of the brush lying in the range 6/100 mm to 40/100 mm along at least a fraction of the applicator member, a plurality of bristles carried by this portion coming to within a distance of less than 1.5 mm from the inside surface of the container under the wiper member in a storage position or while the applicator is being withdrawn along the longitudinal axis of the container.

20 Claims, 8 Drawing Sheets

(51) Int. Cl.

| | |
|---|---|
| ***A45D 40/26*** | (2006.01) |
| ***A46B 9/02*** | (2006.01) |
| *A46B 13/02* | (2006.01) |

(56) References Cited

U.S. PATENT DOCUMENTS

| | | | | |
|---|---|---|---|---|
| 4,982,838 | A | 1/1991 | Fitjer | |
| 5,226,744 | A | 7/1993 | Kemmerer | |
| 5,335,465 | A | 8/1994 | Gueret | |
| 5,339,480 | A * | 8/1994 | Murg et al. | 15/106 |
| 6,158,912 | A | 12/2000 | Miraglia et al. | |
| 6,508,603 | B1 | 1/2003 | Vasas | |
| 6,572,296 | B2 | 6/2003 | Schrepf | |
| 8,206,049 | B2 * | 6/2012 | Thiebaut | 401/122 |
| 8,210,763 | B2 * | 7/2012 | Gueret | 401/129 |
| 2001/0052348 | A1 | 12/2001 | Fischer et al. | |
| 2002/0027144 | A1 | 3/2002 | Lacout | |
| 2003/0213498 | A1 | 11/2003 | Gueret | |
| 2005/0232681 | A1 | 10/2005 | Gueret | |
| 2006/0056903 | A1 | 3/2006 | Gueret | |
| 2006/0233588 | A1 | 10/2006 | Gueret | |
| 2007/0079845 | A1 | 4/2007 | Gueret | |

FOREIGN PATENT DOCUMENTS

| | | | |
|---|---|---|---|
| EP | 1 304 058 | A1 | 4/2003 |
| EP | 1 342 428 | A1 | 9/2003 |
| EP | 1 607 020 | A1 | 12/2005 |
| EP | 1 690 466 | A1 | 8/2006 |
| FR | 2 598 299 | A1 | 11/1987 |
| FR | 2 798 267 | A1 | 3/2001 |
| FR | 2 909 270 | A1 | 6/2008 |
| JP | A-52-066056 | | 6/1977 |
| JP | U-56-045408 | | 4/1981 |
| JP | A-3-060602 | | 3/1991 |
| JP | A-2002-104557 | | 4/2002 |
| JP | A-2006-116363 | | 5/2006 |
| JP | A-2008-114071 | | 5/2008 |
| JP | A-2008-532615 | | 8/2008 |
| WO | WO 2004/017792 | A1 | 3/2004 |
| WO | WO 2006/090343 | A1 | 8/2006 |
| WO | WO 2006/005973 | | 9/2006 |
| WO | WO 2009/153753 | A1 | 12/2009 |

OTHER PUBLICATIONS

Written Opinion of the International Searching Authority issued in International Application No. PCT/IB2010/052114 dated Sep. 30, 2010.

International Search Report issued in International Application No. PCT/IB2010/052115 dated Dec. 27, 2010.

Written Opinion of the International Searching Authority issued in International Application No. PCT/IB2010/052115 dated Dec. 27, 2010.

U.S. Appl. No. 13/319,887, filed Nov. 10, 2011 in the name Jean-Louis Gueret.

Nov. 19, 2013 Office Action issued in Chinese Patent Application No. 201080032105.5 (w/ English Translation of Summary).

May 19, 2014 Office Action issued in Japanese Patent Application No. 2012-510431 (w/ English Translation of Summary).

Jun. 2, 2014 Office Action issued in Japanese Patent Application No. 2012-510432 (w/ English Translation of Summary).

Feb. 21, 2014 European Search Report issued in European Patent Application No. 10 723 791.9.

* cited by examiner

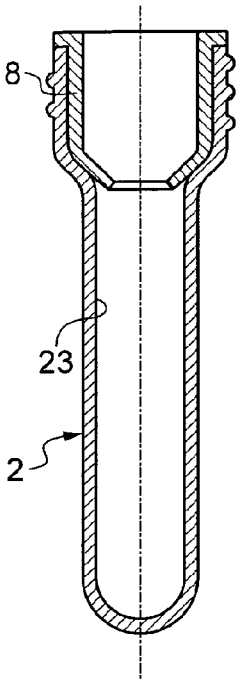
Fig.8H
Fig.8J
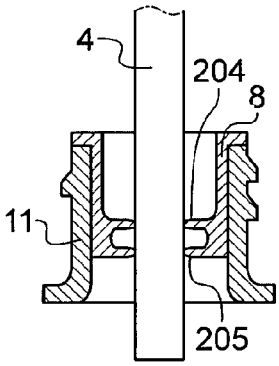
Fig.8K
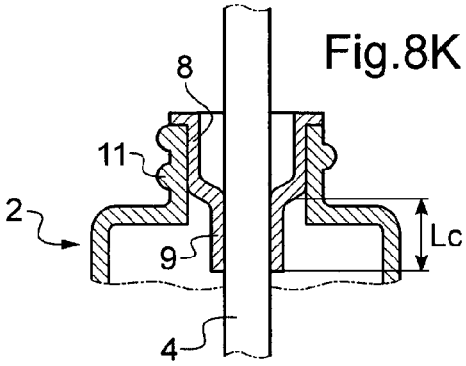
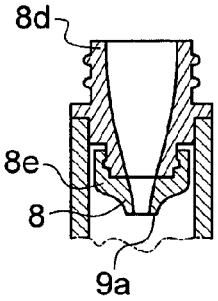
Fig.8M
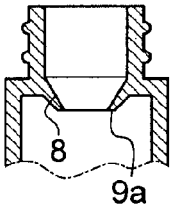
Fig.8N
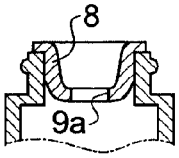
Fig.8O
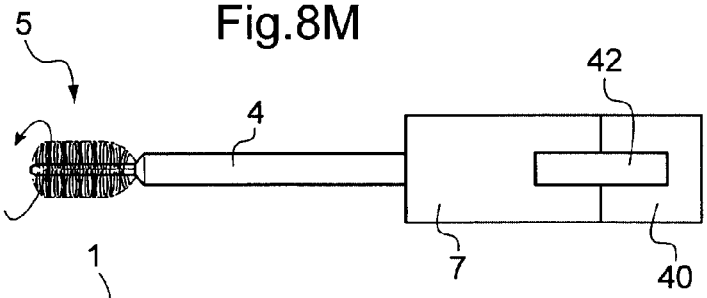
Fig.9
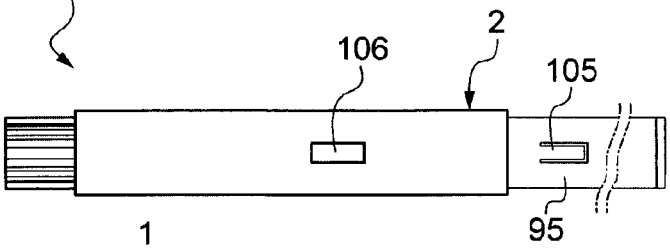
Fig.10
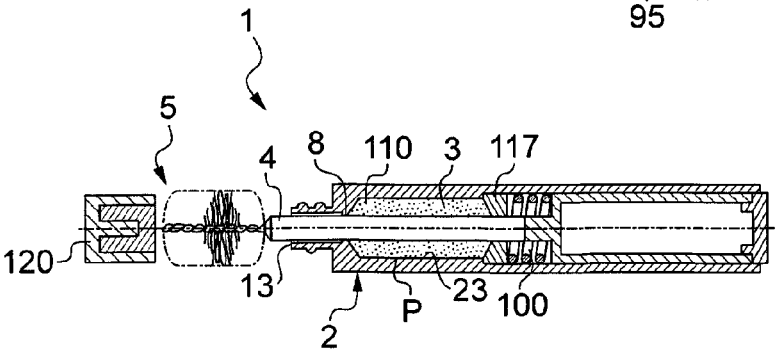
Fig.11

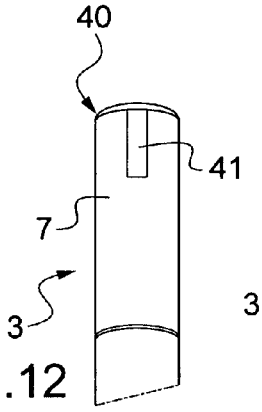
Fig.12
Fig.13
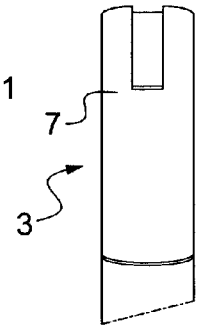
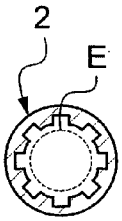
Fig.17B
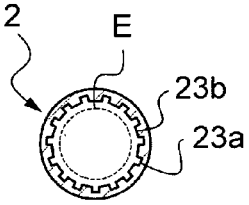
Fig.17A
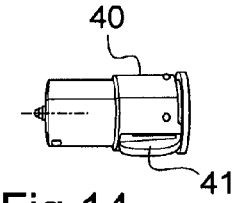
Fig.14
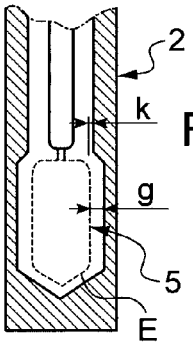
Fig.15
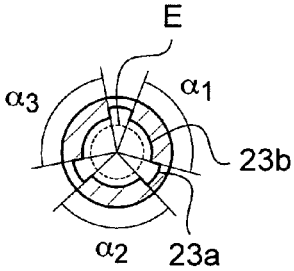
Fig.17C
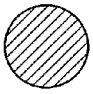
Fig.16A
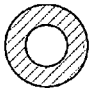
Fig.16B
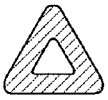
Fig.16C
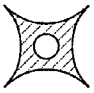
Fig.16D
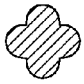
Fig.16E
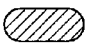
Fig.16F
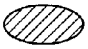
Fig.16G
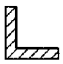
Fig.16H
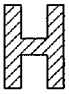
Fig.16I
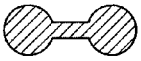
Fig.16J
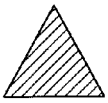
Fig.16K
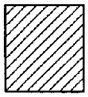
Fig.16L
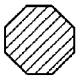
Fig.16M
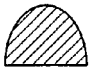
Fig.16N
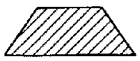
Fig.16O
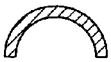
Fig.16P

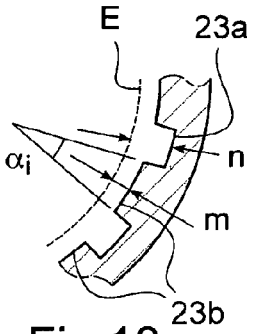
Fig.18
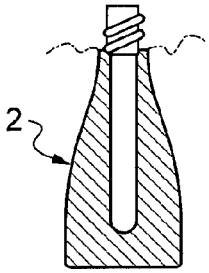
Fig.19A
Fig.19B
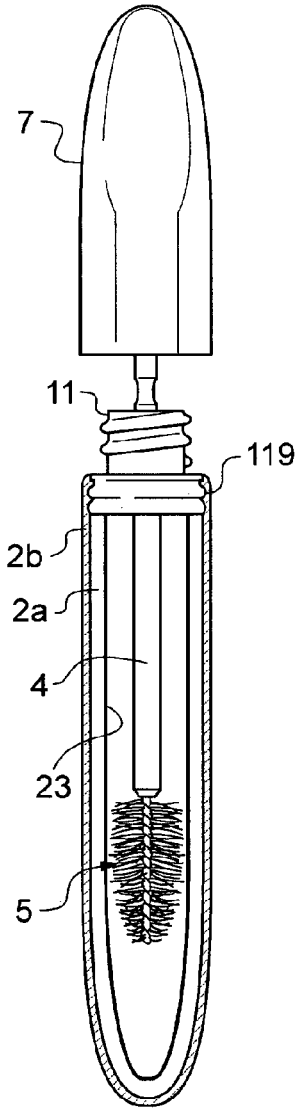
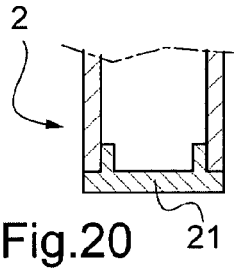
Fig.20
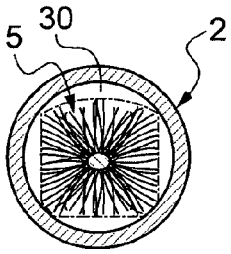
Fig.21
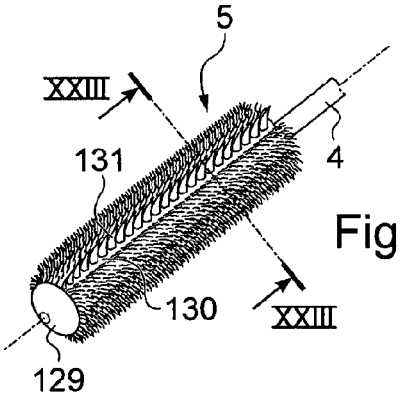
Fig.22
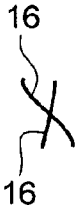
Fig.24A
Fig.24B
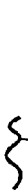
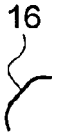
Fig.24C
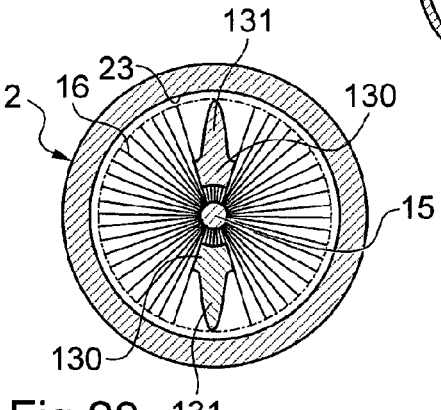
Fig.23

PACKAGING AND APPLICATOR DEVICE

BACKGROUND

The present invention relates to packaging and applicator devices for applying a cosmetic composition to human keratinous fibers, and more particularly but not exclusively to the eyelashes or the eyebrows.

Numerous mascara applicators comprise a container provided with a wiper member fitted in the collar of the container, and an applicator having an applicator member such as a brush located at one end of a stem having its other end secured to a handle member that also constitutes a closure cap for the container.

The wiper member comprises a lip defining a wiper orifice of diameter that corresponds substantially to the diameter of the stem, so as to ensure that there is no excess composition on the stem once it has been extracted from the container.

The container is made with an inside volume that is suitable for multiple applications of composition, and the free ends of the bristles of the applicator member are situated at a relatively large distance from the inside surface of the container.

In use, a chimney forms in the composition because of the movement of the applicator member, and under certain circumstances this can lead to the container being emptied by a percentage that is not satisfactory, e.g. less than or equal to 60%, with some of the composition remaining unused because it is stuck to the inside surface of the side wall of the container. Furthermore, composition may be taken up in a manner that is non-uniform or that is even insufficient because of the chimney that is formed.

In addition, the composition is stirred relatively little inside the container each time the applicator is withdrawn and returned, so its characteristics may deteriorate.

In order to make the composition more uniform again, it is known to place a piston inside the container, which piston is moved by the stem carrying the applicator member whenever the applicator is removed or returned. The piston makes the container more complicated to fabricate and leads to the applicator member being wiped in a manner that is relatively difficult to control, and that can be detrimental to consistent performance of the applicator. The piston may also reduce the space available for containing the composition and may be incapable of making the composition uniform all the way to the bottom of the container. In addition, the piston may make manipulation more complicated and uncomfortable by creating a jolt when the brush separates from the piston. The piston may also lead to duplicate wiping which may make it impossible to use brushes in a sufficient variety of shapes required for good application of makeup.

The piston may also retain composition, particularly if the piston is perforated.

In order to stir the composition contained in the container better, U.S. Pat. No. 5,226,744 teaches making the side wall of the container with indentations so as to produce ridges on its inside surface that come into contact with the applicator member when it is inserted in and withdrawn from the container. The applicator member remains well spaced apart from the inside wall of the container except in the vicinity of the ridges. The drawback of such a device is that it makes producing the container more complicated, and the setbacks give the container a shape that departs from the conventional appearance of the most usual devices and may lead to the consumer thinking that the container contains less composition.

Another solution for reducing loss of composition consists in giving the core of the brush a shape that is not rectilinear, so as to cause the brush to contact the inside surface of the side wall of the container, as proposed in U.S. Pat. No. 6,508,603. That solution presents the drawback of complicating fabrication of the brush and of making it more difficult to apply makeup for a user who is used to conventional applicators. In one example, the outside diameter of the container is 0.45 inches (") and the diameter of the brush is 0.25", giving a difference of 0.2" (i.e. 5 millimeters (mm)).

Application US 2005/0232681 teaches making the container that contains the composition with at least one movable partition that serves, when moved, to force the composition to flow between two internal chambers, the applicator member being suitable for placing on the path followed by the composition between the two chambers.

U.S. Pat. No. 6,158,912 teaches making the container with a flexible portion enabling the user to set up movement of the composition towards the brush by pressing on the flexible portion. Such a solution makes the container more complicated to fabricate when the flexible portion is restricted to a fraction only of the container. When the entire container is flexible, then a consumer who is used to rigid containers may have the impression that the device is of poorer quality.

Furthermore, in conventional devices, the volume of composition close to the bottom of the container is generally difficult to take. U.S. Pat. No. 6,572,296 discloses a container in which the bottom matches the shape of the applicator, at least in part.

Finally, mascara sample devices are known that comprise a container of volume that is practically equal to the volume of the brush they receive. U.S. Pat. No. 4,982,838, EP 1 690 466, and US 2001/0052348 disclose such sample devices. The drawback of those sample devices is their small content, and the short length of the stem on which the brush is mounted.

EP 0 922 407 A1 discloses a device comprising a container having a lower part and an upper part rotatable relative to the lower part. The upper part carries a wiper member.

An applicator is fixed on the upper part, and comprises a stem provided at its end with a brush that is close to an internal surface of the lower part of the container.

The stem is off centered relative to the axis of rotation of the upper part, so that turning the upper part is accompanied by sweeping of the internal surface of the container by the brush. Such a device necessitates to provide good sealing between the upper and lower parts and loading of the brush may prove uneven.

SUMMARY

There exists a need to further improve packaging and applicator devices comprising a container defining an inside space containing the composition for application and an applicator having an applicator member that is designed to be loaded with composition in the container.

The invention seeks to satisfy this need, and in exemplary embodiments, it provides a packaging and applicator device, comprising:

a container defining an inside space containing the composition and including a wiper member; and an applicator comprising an applicator member comprising, or even constituted by, a twisted-core brush carrying bristles, there being five to 55 bristles per turn and the diameter of the bristles lying in the range 6/100 mm to 40/100 mm along at least a portion of the applicator member, a plurality of bristles carried by said portion coming to within a distance of less than 1.5 mm, better less than 1 mm or 0.8 mm or 0.5 mm, from the inside surface of the container under the wiper member in a storage position and/or while the applicator is being withdrawn.

The wiper member may be flocked.

In preferred embodiments, the wiper is fixed relative to the container, i.e. is not carried by an upper part of the container rotatable relative to a lower part, contrary to what is disclosed in EP 0 922 407 A1 discussed above.

The composition may be contained in an internal space of the container that is defined, below the wiper member, by a single part, not by two or more parts assembled together.

The axis of the wiper preferably coincides with the longitudinal axis of the container.

By means of the invention, the applicator member behaves somewhat like a piston or a scraper inside the container, over at least a fraction of the stroke for inserting or withdrawing the applicator into or from the container, thereby stirring the composition contained in the container, e.g. over at least half of said stroke. This may serve to disperse ingredients that are incompatible and that need to be mixed together at the last moment, e.g. flakes, fibers, pigments, or active agents, in order to obtain a composition that is more uniform. Stirring the composition may modify its rheology, where appropriate. The applicator may be extracted or returned with the longitudinal axis of the stem that supports the applicator member continuing to coincide with the longitudinal axis of the container. Accordingly, the said plurality of bristles comes to within a distance of less than 1.5 mm from the inside surface of the container under the wiper member in a storage position and/or at a given moment while the applicator is being withdrawn along the longitudinal axis of the container.

The invention may enable the applicator member to become saturated in composition prior to being wiped.

The invention may reduce the risk of forming a chimney in the composition.

For given content, the invention also makes it possible to increase the number of applications, or for given number of applications it makes it possible to decrease the quantity of composition initially present in the container. This result may be obtained without an expensive structure for the container and while enabling the container to retain the appearance of conventional containers, should that be desired. For example, for a container with a content of 6 milliliters (mL), it is possible to insert more than 3 mL of composition, and in particular 3.5 mL to 4 mL. The recoverable percentage may be increased compared with known devices, for example being greater than or equal to 60%, better 70%, or even 80%, 90%, or 98%.

The quantity of composition on the applicator member each time it is extracted from the container may be relatively constant because of the wiping and because the applicator member stirs the composition inside the container. The texture of the composition may also be relatively constant because of the way it is made uniform. The invention may enable new formulation options to be considered, by making it possible to incorporate in the composition compounds that require the composition to be made uniform again immediately prior to taking the composition and applying it.

Where appropriate, the applicator may be used to mix together two compositions or ingredients prior to a first use, e.g. two compositions having different colors. It is possible to mix fatty material with water so as to obtain a smoother result, greater gloss, or better application of makeup.

The invention may also improve the extent to which the applicator member is impregnated with composition on first insertion into the container, by causing the composition to pass more easily through the applicator member. Thus, the applicator member may be fully usable as from the first occasion it is extracted from the container. When fibers are present in the composition, they may spread within and over the brush, after the brush is wiped.

The number of bristles per turn corresponds to the number of bristle ends in the same helical sheet clamped between two consecutive segments of the core and inclined obliquely relative to the longitudinal axis of the core, as counted by a stationary observer for the brush being turned through 180° about the core.

The relatively low density of bristles per turn allows a certain amount of composition to pass through the applicator member while it is being moved inside the container. Thus, moving the applicator member inside the container is not made too difficult in spite of the small clearance that exists relative to the container, at least in certain locations.

By way of comparison, for a greater density of bristles than in the invention and with an envelope surface of circular section in a container that is itself of circular section, and with small spacing between the envelope surface and the inside surface of the container, the brush is found to be too difficult to move and may give rise to a pistoning effect that is harmful to proper loading with composition and that may lead to the brush, the stem, or the wiper becoming dirtied or to the composition leaking.

Said portion may have six to 50, better eight to 50 bristles per turn, better still ten to 45 or even ten to 25 bristles per turn.

Said portion may have bristles of diameter lying in the range 8/100 mm to 35/100 mm, better in the range 10/100 mm to 30/100 mm.

Said portion may extend over at least half the length of the portion of the core that carries bristles.

The envelope surface may be of cross-section that is axially symmetrical, or that is a surface of revolution.

The entire perimeter of said portion may be situated at less than 1.5 mm from the inside section of the container, in particular during storage.

The envelope surface of the applicator member may be cylindrical, e.g. a cylindrical surface of revolution, or it may be a cylinder of non-circular section, e.g. of section that is polygonal, e.g. square, pentagonal, or triangular, hexagonal, or oblong, e.g. lenticular or elliptical, at least over a fraction of the length of the applicator member. Said portion may thus have an envelope surface that is cylindrical. The applicator member may have a majority of bristles of the same length.

The said portion of the brush carrying the bristles where there is 5 to 55 bristles per turn and a diameter lying in the range 6/100 mm to 40/100 mm and that comes to a distance of less than 1.5 mm or in contact with the inside container during storage or withdrawal, may be located elsewhere than at a distal end of the brush, for example at least at a distance of ¼ of the length of the bristle carrying portion from the distal end thereof.

The container may have an inside section that is similar to the section of the envelope surface of the brush, over at least a fraction of its length, e.g. an inside section that is circular when the envelope surface of said portion is a cylinder of circular section, triangular section, . . . .

The generator line of the envelope surface of said portion of the brush, when it is cylindrical, is preferably parallel to the longitudinal axis of the container, along which the applicator member may be extracted or returned.

Said distance between the bristles and the inside surface may be less than or equal to 1 mm, better less than or equal to 0.5 mm. Said portion may come to within a distance of less than 1.5 mm from the inside surface of the container over an angular sector of at least 90° around the longitudinal axis of the container. If it makes contact with said surface, such contact may optionally lead to the bristles bending.

The height of the inside space of the container, beneath the wiper member, may be greater than or equal to twice the length of the portion of the core that carries bristles.

The applicator may include a stem provided with a flexible portion capable of deforming on withdrawing or returning the applicator from or to the container.

In exemplary embodiments, the applicator member when placed within the container may be situated at a distance j from the inside surface of the container that is less than or equal to 1.5 mm, at at least two locations that are spaced apart from each other by more than 3 mm along the longitudinal axis of the core. The two above-mentioned locations may be spaced apart by more than 5 mm along the longitudinal axis of the core, or indeed by more than 10 mm or more. The two locations may for example be respectively each of them less than 5 mm from the distal or proximal end of the applicator member.

The applicator member may include bristles at its proximal and distal ends that are spaced apart by more than 1.5 mm from the inside surface of the container, in particular when the applicator is in the storage position inside the container.

The applicator member may have an envelope surface of cross-section that decreases going towards the distal end, e.g. having a shape that is frustoconical or otherwise tapering, converging towards the distal end. This may make it easier to return the applicator into the container.

The applicator member may have an envelope surface of greater outside diameter $d_{max}$ and the container may have a mean inside diameter $\overline{d_{int}}$ under the wiper member such that the difference $|d_{max}-\overline{d_{int}}|$ is less than or equal to 3 mm. For example, $d_{max}$ may be 10 mm and $\overline{d_{int}}$ 10.5 mm.

The applicator member may present an envelope surface of cross-section that is not circular, which section may serve to define at least one preferential passage for the composition, in particular when the container presents an inside section that is circular. The preferential passage may be defined by at least one groove or furrow formed in the applicator member, with the bottom thereof being situated at a distance from the container that is greater than or equal to 1.5 mm, e.g. an annular groove or a helical furrow, of depth that is greater than or equal to 1 mm or even 2 mm, for example. The preferential passage may extend over the entire length of the applicator member, e.g. being non-rectilinear, and in particular being twisted, e.g. being defined by a helical furrow. Such a helical furrow need not extend over the entire length of the applicator member. The furrow may extend with a left-hand pitch, or with a right-hand pitch, or with a left-hand pitch over a fraction thereof followed by a right-hand pitch over another fraction.

The existence of a preferential passage makes it possible to further reduce the head loss and the resistance that needs to be overcome in order to move the applicator member inside the container, and may also contribute to improving making the composition more uniform.

The preferential passage may be a passage that provides the composition with a flow section that is greater than that defined by the clearance, if any, that exists between the applicator member and the inside surface of the container, where the applicator member is no more than 1.5 mm from the inside surface of the container.

The preferential passage may extend to the core of the brush.

The applicator member may have an envelope surface of cross-section that is not circular, in particular it may be flat, and it may turn about the longitudinal axis of the applicator member on moving along the applicator member.

Particularly with a twisted applicator member, the container may present a zone that is situated at less than 1.5 mm from the applicator member and that extends along a helical path over the inside surface of the container.

For a given axial position along the longitudinal axis of the container, the zone of the inside surface of the container that is situated at less than 1.5 mm from the applicator member may occupy a total angular extent of less than 90°, where appropriate, particularly if the applicator member presents a cross-section that is very flat and of small thickness.

The applicator member may have an envelope surface of cross-section that is polygonal, over at least a fraction of its length, in particular said portion carrying bristles having the above-specified characteristics.

Where appropriate, the composition may flow between rows of bristles that define preferential passages between one another.

When the applicator member carrying no composition is observed along its longitudinal axis, it is possible in certain exemplary embodiments to see through the applicator member inside the perimeter of the envelope surface. Such open zones constitute preferential passages, in particular when they are of section that is greater than or equal to 1 square millimeter ($mm^2$), or more, in particular more than 2 $mm^2$, 3 $mm^2$, or 5 $mm^2$.

The inside surface of the container may be invariable.

The term "invariable" as applied to the inside surface should be understood as meaning there is no change to the inside shape of the container in the region facing and surrounding the applicator member, in particular there is no movable partition, unlike that which is described in US 2005/0232681, or else without any wall that is deformable in use.

The inside surface of the container may be cylindrical, in particular it may be a cylindrical surface of revolution.

The container may be rigid, visibly not being deformed by the user when taking composition. The container may be made without any moving part, for example no upper part rotatable relative to a lower part. The container may be made with a rigid wall defining its inside surface.

The container may be made with an insert that defines the inside space containing the composition and a cladding piece that defines the outside shape of the container.

The insert may be made by molding material to present a neck, in particular a threaded neck suitable for supporting the wiper member. The insert may also be made with a collar enabling it to be fastened in the cladding piece, e.g. by snap-fastening. The insert may have an inside section that is constant over the major fraction of its length, e.g. a section that is circular. The bottom of the insert may be in the form of a spherical cap.

The presence of the insert makes it possible to reduce the inside section of the container and to use an applicator member having a diameter that is no greater than that of conventional applicator members, while still ensuring small or zero clearance between the applicator member and the inside surface of the container.

The applicator member may comprise any type of bristle extending from the core, and the core need not necessarily be centrally located. The core may be central when the applicator member is constituted by a cylindrical brush, the envelope surface then having a section of the same shape as the container.

The envelope surface of the applicator member is defined as being the surface touching the tips of the free ends of the bristles.

The region(s) of the applicator member coming into contact with or at a short distance from the inside surface of the container over which the applicator member travels, e.g. coming to within 1.5 mm thereof, better to within 1 mm or 0.5 mm, may themselves be of a length that is greater than 5 mm as measured along the longitudinal axis of the applicator member, or even greater than 10 mm or 15 mm, and in particular they may extend over a major fraction of the length of the applicator member that is suitable for use in applying the composition, e.g. over more than ¾ths of said length, or they may extend over the entire length of the applicator member.

Where appropriate, the cross-section of the envelope surface may pass through an extremum, in particular a maximum. Whether or not the cross-section passes through an extremum, the greatest transverse dimension of the envelope surface of the applicator member may be equal to at least 0.85 times the inside diameter of the container in the portion within which the applicator member travels, beneath the wiper member, and better has a value of 0.90 times or 0.95 times said diameter.

The greatest transverse dimension of the applicator member may also be equal to or greater than the inside diameter of the container in the portion through which the applicator member travels beneath the wiper member, the greatest transverse dimension being for example greater than the greatest inside diameter of the container by a factor lying in the range 1 to 1.15 times.

The greatest transverse dimension may be found at a distance from the proximal and/or distal ends that is greater than ¼th of the total length of the portion of the applicator member that is used for application purposes.

The inside diameter of the container may be at a maximum in the portion of the container through which the applicator member travels.

Outside the region(s) of the applicator member close to or in contact with the inside surface of the container, the applicator member may for example have its envelope surface spaced apart therefrom by more than 0.075 times the greatest inside diameter of the container, with said spacing corresponding for example to a distance of more than 1.5 mm.

The portion of the container under the wiper member, i.e. the portion where the applicator member is capable of moving at zero or small distance from the inside surface of the container, e.g. with $|d_{max}-d_{int}|\leq 3$ mm, better ≤2 mm, better still ≤1.5 mm or ≤0.5 mm, preferably extend over the major fraction of the height of the inside space of the container, and preferably at least in part in the bottom half of the container. If $D_r$ designates the greatest inside diameter of the container in the portion through which the applicator member travels, and $d_{max}$ is the greatest transverse dimension of the applicator member, then it is possible for $d_{max}<D_r$ or $d_{max}>D_r$, i.e. the applicator member then rubs against the inside surface of the container.

Depending the exemplary embodiments, when in the storage position, the applicator member may be close to or spaced apart from the bottom wall of the container. For example, the distal end of the applicator may be situated at less than 1.5 mm from the bottom wall of the container.

The applicator member may then travel along at least its own length inside the container, above its initial location, on being extracted from the container.

The length of the portion of the applicator member that carries the bristles may be greater than or equal to 15 mm. The length of the applicator member may lie in the range 5 mm to 35 mm, for example, better in the range 20 mm to 30 mm, and its greatest transverse dimension $d_{max}$ may for example lie in the range 6 mm to 20 mm, better in the range 7 mm to 16 mm.

The invention may enable containers to be used that are shorter than conventional containers because of the higher recoverable percentage.

The applicator member may present an envelope surface with or without axial symmetry, for example it may have axial symmetry about an axis that coincides with the longitudinal axis of the applicator member, in particular with the longitudinal axis of the core of the applicator member. The envelope surface of the applicator member may optionally be a symmetrical surface of revolution about the longitudinal axis of the core.

The applicator member may have a core that is rectilinear, e.g. situated on the axis of the stem carrying the applicator member. Preferably, the stem is rectilinear so as to enable the applicator member to be properly aligned in the container.

The wiper member may be fitted to the container, overmolded on the container, or molded together with the container. The wiper member may define a wiper lip that presents a wiper orifice of section that corresponds substantially to the section of the stem of the applicator for supporting the applicator member. The wiper member may optionally occupy a position within the container that is variable.

The capacity of the container may for example be greater than or equal to 3 mL, better 5 mL, e.g. lying in the range 3 mL to 10 mL. The level to which the container is filled compared with its maximum capacity is preferably greater than or equal to 50%, e.g. lying in the range 50% to 75%, e.g. 5 grams (g) of composition for a container capable of containing 8 g.

The container preferably presents an inside cross-section that is circular and of diameter that is substantially constant along a length that is equal to at least 1.5 times, preferably two to ten times the length of the applicator member, e.g. a length lying in the range 20 mm to 100 mm, better in the range 40 mm to 100 mm. This may enable the applicator member to move at a short distance from or in contact with the container over a distance that is relatively long, in order to enable the composition to be well stirred within the container.

The core may be made of metal wire, e.g. of wire having a diameter lying in the range 0.35 mm to 0.95 mm. The bristles may extend from the core in two helical sheets. The bristles may be made of natural or synthetic material, for example they may be made of polypropylene (PP), polyamide (PA), polyethyleneterephthalate (PET), polystyrene (PS), polyethylene (PE), or polyvinylchloride (PVC), elastomers, silicones, nitriles, ethylene propylene diene (EPDM) elastomer (e.g. Santoprene®), block amide polyether (e.g. Pebax®), polyester (e.g. Hytrel®), or styrene ethylene butylene styrene (SEBS), polyurethane (PU), . . . . The core may have a left-hand twist, or a right-hand twist, or it may have a portion that is twisted to the left and a portion that is twisted to the right, e.g. half twisted to the left and half twisted to the right. The bristles may include a magnetic filler or a filler that seeks to improve sliding, e.g. graphite, polytetrafluoroethylene (PTFE), or molybdenum bisulfide.

The diameter of the stem carrying the applicator member may lie for example in the range 2.5 mm to 6 mm, with the stem being circular in section, for example.

The applicator member may include a twisted portion of flat cross-section, having its greatest transverse dimension preferably lying in the range 8 mm to 16 mm. Its greatest transverse dimension may in particular be greater than 9 mm and the thickness of its twisted portion may lie in the range 2 mm to 6.5 mm.

The twisted portion may present an angular offset between its distal and proximal ends that may be relatively small. The term "angular offset" is used to mean the angle through which the long axis of the cross-section turns between said ends.

This angular offset may be more or less equal to the angle through which the user is likely to rotate the applicator about its axis while applying makeup. Because of this small offset, the applicator member may, when lightly twisted in the hand, progressively raise the eyelashes in a manner that is natural. The angular offset between the distal end and the proximal end of the twisted portion may lie in the range 20° to 80°, and better is less than 35°, better still lies in the range 25° to 35°, or indeed is equal to about 30°. In variants, the angular offset may also be more than 360°.

The twisted portion may extend over at least half the length of the applicator member, better over at least three-fourths of the length, preferably over substantially all of its length. The twisted portion may also extend over a length that lies in the range 20 mm to 35 mm, for example. The length of the applicator member is defined as being the length of the portion of the core that carries bristles.

The angle between the major axis of the cross-section of the applicator member at any point along the longitudinal axis of the core, and a reference direction, may vary continuously on moving along the longitudinal axis of the core. One end of said major axis may describe a helix of regular pitch about the longitudinal axis of the core. In a variant, the angle may vary in non-regular manner. One end of said major axis may form a helix of variable pitch around the longitudinal axis of the core, which pitch may for example increase in direction from a distal end of the applicator or it may decrease in direction from said distal end, or indeed it may increase and then decrease or decrease and then increase.

The twisted portion may be twisted clockwise or counterclockwise or in both directions over two respective consecutive portions.

The twisted portion may be at least 30% wider than it is thick in cross-section. In other words, the greatest length of the cross-section of the applicator member may be equal to at least 1.3 times its thickness. The twisted portion of the applicator member may lie in the range 30% to 100% wider than it is thick, better in the range 35% to 55% wider than it is thick. The cross-section of the applicator member may for example be rectangular, oval, oblong, or lozenge-shaped, or kidney-bean-shaped.

The greatest transverse dimension of the twisted portion may lie in the range 6 mm to 14 mm, better in the range 8 mm to 16 mm, as stated above. The width of the twisted portion may be at least 3 mm greater than its thickness. The thickness of the twisted portion may lie in the range 3 mm to 7 mm, better in the range 3 mm to 6 mm.

The applicator member may present two opposite main faces with the spacing between them defining the thickness of the applicator member. These main faces may be mutually parallel. The applicator member may present two side faces, e.g. side faces that are outwardly convex in cross-section. The side faces may be situated at less than 1.5 mm from the inside surface of the container.

In particular when the applicator member presents a twisted portion, the core may be centered or eccentric, rectilinear, or otherwise. The longitudinal axis of the core may coincide with the longitudinal axis of the stem. The longitudinal axis of the core need not necessarily be in alignment with the longitudinal axis of the stem. The core may be curved.

The maximum cross-section of the envelope surface of the applicator member may occupy at least 70% of the inside section of the container, or indeed at least 80% or at least 90%, at least along a fraction of the path followed by the applicator member while it is being extracted from the container, above its initial location.

The quantity of composition that is initially present in the container may be greater, in certain exemplary embodiments, than the volume defined by the envelope surface of the applicator member, e.g. greater by a factor of two. The bottom of the container may present a shape that fits substantially around the shape of the applicator member.

The composition may be of any consistency, e.g. it may be a gel or it may have a consistency that is creamy to pasty. The composition may contain waxes, pigments, fillers, amongst other ingredients.

The applicator may be vibratory, or rotary, in particular being driven in rotation by a motor or being free to rotate, vibratory and rotary, vibratory and heating, or rotary and heating.

BRIEF DESCRIPTION OF DRAWINGS

The invention can be better understood on reading the following detailed description of non-limiting embodiments thereof, and on examining the accompanying drawings, in which:

FIGS. 8A to 8K and 8M to 8O are fragmentary longitudinal section views of other variant wiper members;

FIGS. 9 and 10 show variants of the applicator;

FIG. 11 is a longitudinal section of the FIG. 10 applicator;

FIG. 12 is a fragmentary and diagrammatic view of a variant of the device;

FIG. 13 shows the FIG. 12 device with the vibration source removed;

FIG. 14 shows the vibration source in isolation;

FIG. 15 shows the bottom portion of a variant embodiment of the container;

FIGS. 16A to 16P are cross-section views showing variant embodiments of the bristles;

FIGS. 17A, 17B, and 17C are cross-section views of variant devices made in accordance with the invention;

FIG. 18 shows a detail of FIG. 17B;

FIGS. 19A and 19B show variant embodiments of containers;

FIG. 20 shows a variant embodiment of the bottom of a container;

FIG. 21 is a cross-section of XXI-XXI of FIG. 6B;

FIG. 22 shows a variant applicator member on its own and in perspective;

FIG. 23 shows the applicator member in cross-section on XXIII-XXIII in place in the container; and FIGS. 24A to 24C show various configurations of bristles.

DETAILED DESCRIPTION OF EMBODIMENTS

Figure 1:
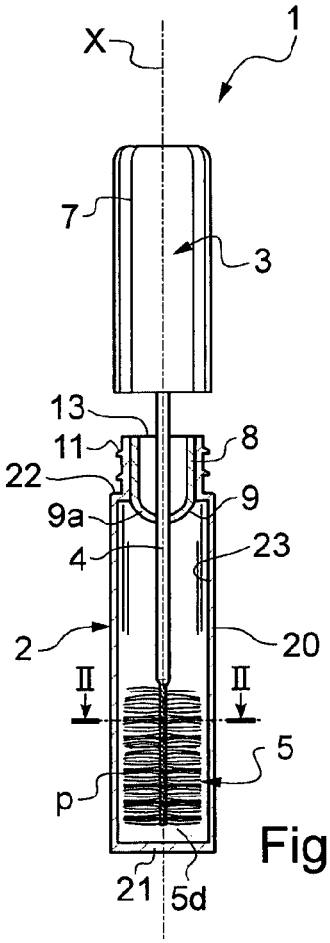
FIG. 1 is a diagrammatic elevation view, partially in longitudinal section, showing an example of a packaging and applicator device made in accordance with the invention.

A packaging and applicator device 1 made in accordance with the invention comprises a container 2 that contains a composition P for application, e.g. mascara, and an applicator 3 that serves to apply the composition P on human keratinous materials, for example keratinous fibers such as the eyelashes or the eyebrows.

The container 2 may be made by any appropriate means, for example by injection molding a thermoplastic material, by blow molding, by injection blow-molding, or by coextrusion, using one or more materials. The body 20 of the container may comprise a single piece or it may be made up of a plurality of parts that are assembled together. The container may be made entirely out of polymer material(s). The container 2 may also be made of glass or of metal.

The applicator 3 comprises a stem 4 having an applicator member 5 mounted at the end thereof. The applicator member may be fitted to the stem 4.

At its end remote from the applicator member 5, the stem 4 may have a handle member 7, as in the example shown, which handle member may also constitute a cap for closing the container 2, as shown. The container may have a threaded neck 11 on which the handle member 7 screw-fastens, the neck 11 defining an outlet orifice 13. The stem 4 may be flexible or rigid.

A wiper member 8 may be mounted in the neck 11 of the container 2, as shown. The wiper member 8 may be made in various ways and may include a wiper lip 9 that defines a wiper orifice 9*a* of diameter that corresponds substantially to that of the stem 4, for example, thereby ensuring that the stem does not present excess composition after being extracted from the container 2.

The inside surface 23 may be substantially in the form of a circular cylinder about the axis X. The inside diameter of the container may for example be substantially constant over a length that extends from the bottom 21 of the container 2 to a shoulder 22 connecting the neck 11 to the side wall of the container, as shown in FIG. 1. By way of example, this length may lie in the range 3 centimeters (cm) to 12 cm.

The applicator member 5 is a brush having bristles 16, which bristles are carried by a twisted core 15, e.g. made of metal. The core 15 may comprise two branches of a metal wire that are twisted together with a right-hand twist or a left-hand twist and that clamp the bristles. The branches may be formed by folding a metal wire into a U-shape. The diameter of the wire may lie in the range 0.35 mm to 1.2 mm. The core may also comprise two twisted-together cores. Under such circumstances, the number of bristles per turn are counted between the turns formed by the cores of the two brushes. These brushes need not have twisted cores.

In certain examples, the number of bristles per turn may lie in the range 10 to 25. The envelope surface E may be a cylindrical surface of revolution, as shown in FIG. 1, or it may have some other shape as described below, in particular it may be of cross-section that is not circular.

The greatest transverse dimension $d_{max}$ of the applicator member 5 may be close to the inside diameter $d_{int}$ of the container 2, as defined by its inside surface 23, and for example $|d_{int}-d_{max}|\leq 3$ mm, better less than or equal to 1.5 mm, better still less than or equal to 1 mm.

By way of example, $d_{max}$ may be 10 mm and $d_{int}$ may lie in the range 10.5 mm to 11.5 mm.

Figure 3:
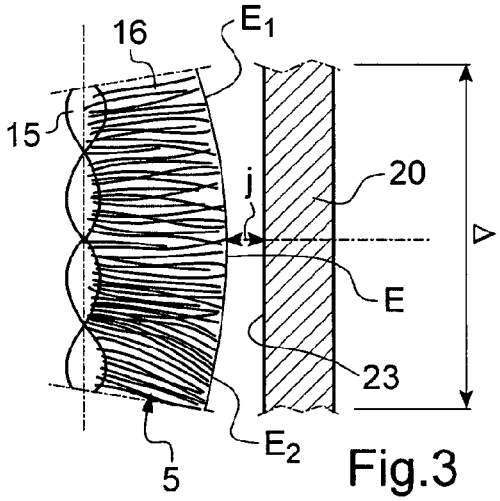
FIG. 3 shows a detail of the FIG. 1 device.

The envelope surface E may be situated at a distance j from the inside surface 23 of the container that is relatively small, less than 3 mm, better less than 1.5 mm, better still less than 1 mm or 0.5 mm, e.g. over the major fraction of the length of the applicator member, as shown in FIG. 3.

Thus, in general, there may be at least two locations $E_1$ and $E_2$ that are spaced apart along the axis X by a distance Δ of at least 3 mm, better 5 mm, or even 10 mm, 15 mm, 20 mm, or 25 mm, at which locations the applicator member 5 is at a small distance from the inside surface 23, and at which locations the difference between the greatest transverse dimension at this position along the axis X and the inside diameter of the container at the same position along the axis X is less than 3 mm, better less than 1.5 mm.

Naturally, the invention is not limited to a particular applicator member 5 and variants may make it possible to create one or more preferential passages inside the container, while still having an applicator member that is situated at least in certain locations at a small distance from the inside surface 23 of the container 2.

Figure 2:
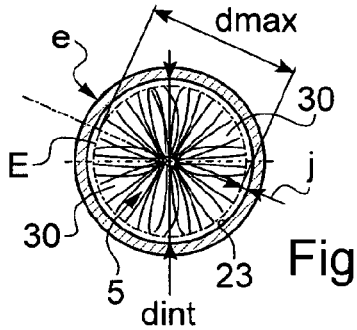
FIG. 2 is a cross-section on II-II of FIG. 1.

By way of example, FIGS. 5A to 5L show embodiments of the applicator member having cross-sections of shapes other than that of the example of FIGS. 1 to 3.

Figure 5A:
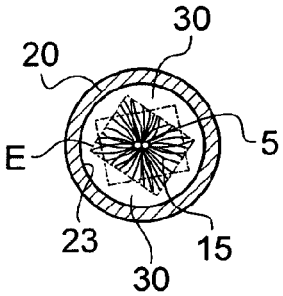
FIGS. 5A to 5K are cross-sections showing variant embodiments of the applicator member.
Figure 5B:
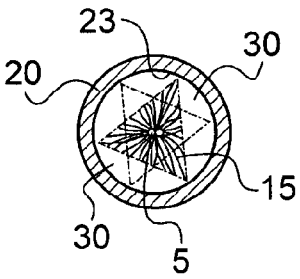
Figure 5C:
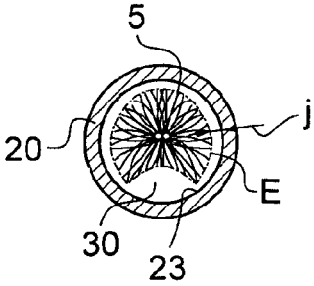
Figure 5D:
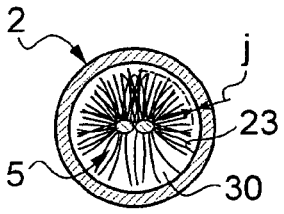
Figure 5E:
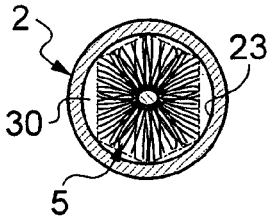

For example, the cross-section of the envelope surface of the applicator member may be substantially polygonal in shape over at least a fraction of the length of the applicator member, as shown in FIGS. 5A and 5B, e.g. square as shown in FIG. 5A, triangular as shown in FIG. 5B, or hexagonal as shown in FIG. 5E. Preferential passages are formed between the sides of the polygon and the inside surface 23 of the container.

The vertices of the polygon lie at a small distance from the inside surface 23 of the container, e.g. less than 1.5 mm, or even at a smaller distance, in particular less than 1 mm or less than 0.5 mm. The applicator member 5 may touch the inside surface 23 of the container, in particular at the vertices of the polygon.

Depending on the variant, the cross-section of the applicator member may optionally turn about the longitudinal axis of the core on moving along the longitudinal axis of the core. For example, the cross-section may turn through at least the bisector of the angle formed around the longitudinal axis of the core between two vertices of the polygon, if the section is polygonal, e.g. as shown in FIGS. 5A and 5B.

Figure 6A:
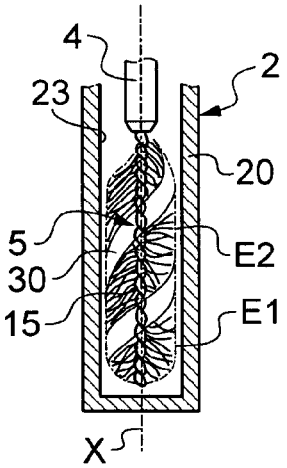
FIGS. 6A to 6N, 6P and 6Q are fragmentary and diagrammatic views of other variant embodiments of the applicator member.

As shown in FIG. 5C, the applicator member 5 may also include at least one groove 30 that extends as a recess along the applicator member, e.g. following a helical path, as shown in FIG. 6A. The helical groove may extend over 360° or less, e.g. 30°, 60°, or 90°. A plurality of helical grooves may be provided. The helical grooves may turn clockwise or counterclockwise.

By way of example, the groove 30 is formed by a notch, e.g. made by machining the brush, as shown in FIG. 5C, and it defines a preferential passage for the composition enabling it to flow along the applicator member when the applicator member is moved relative to the container.

The clearance j between the envelope surface E and the applicator member 5, away from the groove 30, and the inside surface 23 of the container may be relatively small, e.g. 1.5 mm, or even less.

The applicator member may be made with projecting elements, in particular bristles, at densities that vary within a section, so as to create a preferential passage for the composition where the density is smaller.

FIG. 5D shows an applicator member having two opposite regions with different densities of projecting elements. The region where the density is lower defines a preferential passage 30 for the composition. In the example of FIG. 5D, the applicator member is a twisted-core brush. By way of example, the lower density may be less than half the higher density.

Figure 5F:
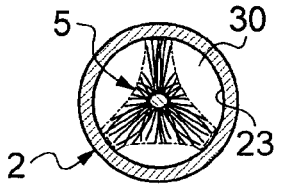
Figure 5G:
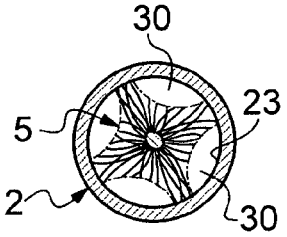

Other section shapes, star-shaped sections, are shown in FIGS. 5F and 5G.

In the example of FIG. 5F, the section defines three branches, and in the section of FIG. 5G, it defines four branches. Preferential passages 30 are defined between the branches.

In these examples in particular, the applicator member may present a section that optionally turns about the longitudinal axis of the core.

The radially outermost ends of the branches are at a small distance from the inside surface 23, e.g. less than 1.5 mm, better less than 1 mm, or even 0.5 mm, or they may be in contact with the inside surface 23.

Figure 5H:
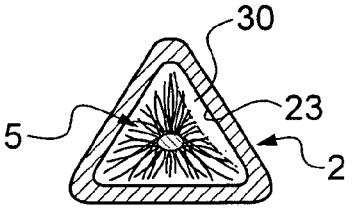
Figure 5I:
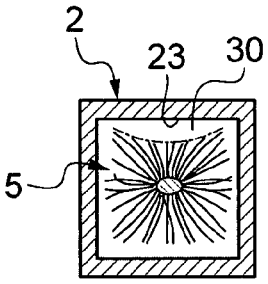

The container 2 may present an inside cross-section that is of a shape other than circular, as shown in FIGS. 5H and 5I in particular.

These figures show a container having an inside cross-section that is substantially polygonal in shape, e.g. triangular or square.

The envelope surface of the applicator member, when observed in cross-section, may present a shape that is similar, e.g. substantially polygonal as in the example shown. At least one preferential passage 30 may optionally be formed as shown between one side of the polygon and the corresponding side of the inside surface of the container, e.g. by forming a recess in one of the faces of the applicator member. Apart from this recessed face, the remainder of the applicator member may lie at a relatively small distance from the inside surface of the container, in particular at a distance that is less than or equal to 1.5 mm. In a variant, all of the faces of the envelope surface corresponding to the sides of the polygon are situated at less than 1.5 mm from the inside surface of the container.

When the inside section of the container is not circular, in particular when it is polygonal, the applicator member may be extracted from the container, optionally while being turned about the longitudinal axis of the container. For example, the applicator member may be withdrawn without being turned relative to the container, e.g. with the applicator being fansted to the container by clip-fastening. In a variant, the applicator member is extracted with the applicator member turning relative to the inside surface of the container. The applicator member or the stem may also turn freely relative to the closure cap of the container that also serves as a handle for the applicator.

In particular when the container presents an inside cross-section that is not circular, the applicator may be fansted to the container with its position in rotation relative to the container being indexed, so that when in a storage configuration, the projecting elements are not pressed against the inside surface of the container. For this purpose, complementary portions in relief may be provided that are formed respectively on the container and on the applicator, in particular on an assembly skirt thereof, used for fixing it on the container and to which the applicator member may be connected.

Figure 6B:
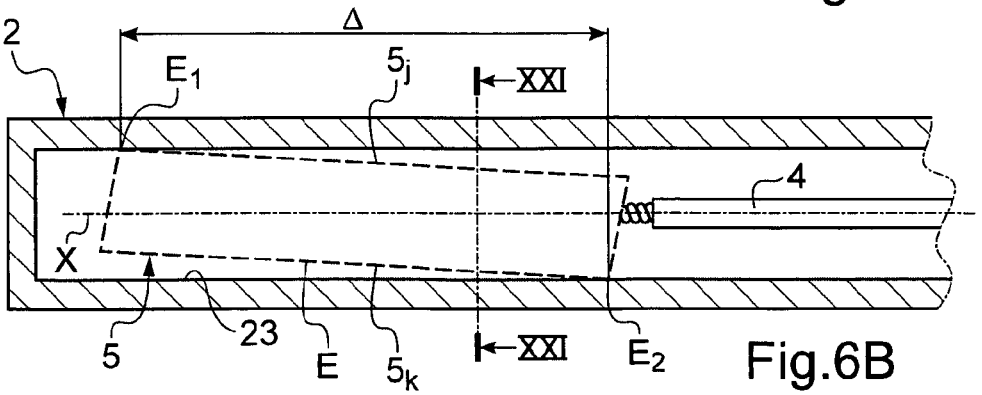

FIG. 6B shows a variant embodiment in which the applicator member comes into contact with or close to the inside surface 23 of the container 2 and at least two locations $E_1$ and $E_2$ that are spaced apart by a distance Δ along the longitudinal axis X of the core that is greater than 3 mm, better greater than 5 mm, or indeed greater than 11 mm or 15 mm.

In this example, the applicator member 5 is eccentric, i.e. the longitudinal axis of the core does not coincide with the center of gravity of the section of the envelope surface E taken perpendicularly to the longitudinal axis X.

In the example shown, the longitudinal axis X is parallel to the longitudinal axis of the stem 4 and also parallel to the longitudinal axis of the container.

The applicator member 5 presents two opposite sides 5*j* and 5*k* at a distance from the inside surface 23 that varies on going along the axis X.

For example, the side 5*j* is at a distance from the inside surface 23 that increases on going towards the proximal end of the applicator member, while, on the contrary, the side 5*k* is at a distance that then decreases.

The locations $E_1$ and $E_2$ form parts respectively of the sides 5*j* and 5*k* in the example of FIG. 6B. By way of example, these sides are defined by mutually parallel plane faces that are at an angle relative to the longitudinal axis of the container. By way of example, the locations $E_1$ and $E_2$ are situated respectively close to the distal and proximal ends of the applicator member 5. In variants that are not shown, the shape of the envelope surface E is modified from that shown in FIG. 6B, while conserving two locations $E_1$ and $E_2$ that are situated close to the distal and proximal ends and while conserving an eccentric section.

At least one preferential passage 30 is formed around the applicator member by the clearance that exists between it and the inside surface 23, at locations other than $E_1$ and $E_2$, as can also be seen in FIG. 21.

FIG. 6B corresponds merely to one example amongst others of possible shapes for the envelope surface. In particular, the branch may be as shown in FIG. 1A, 1B, 2, 3, 4, 5, 6, 7, 8, 9A, 10A, 11, 12A, 12B, 13, 14A, 15, or 16 of patent EP 1 177 745 B1. The description corresponding to those figures as given in that patent is incorporated herein by reference.

Figure 6C:
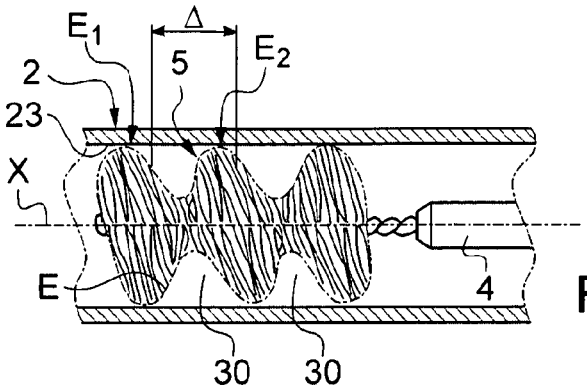

The applicator member 5 may be in contact with or close to the inside surface 23 of the container at a plurality of locations that are spaced apart along the axis X, e.g. three or more locations, as shown in FIG. 6C.

In this figure, the envelope surface E of the applicator member presents a cross-section that passes through a plurality of extremums, e.g. having a longitudinal section with undulations.

At each maximum of the cross-section, the envelope surface may be situated in contact with or at a small distance from the inside surface 23 of the container, e.g. at less than 1.5 mm, better less than 1 mm, or even 0.5 mm.

A preferential passage 30 for the composition is created between two consecutive locations, e.g. those referenced $E_1$ and $E_2$, where the applicator member comes to close or into contact with the inside surface of the container.

The envelope surface E may be in the form of a symmetrical surface of revolution, or in some other form. The spacing Δ between said locations may be greater than 3 mm.

Figure 6D:
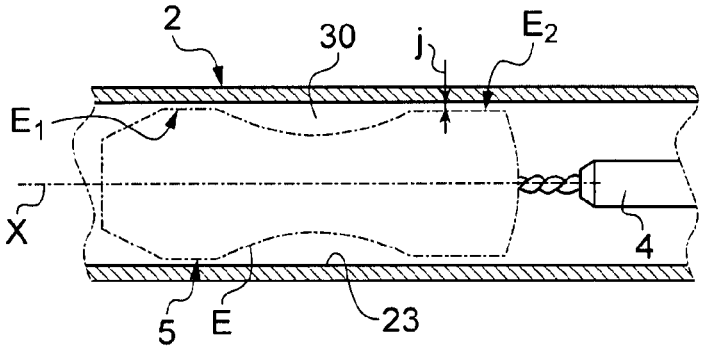

In the example of FIG. 6D, the applicator member 5 is made with one or more longitudinal notches or with a narrowing of its inside section in order to define at least one preferential passage 30 for the composition, between two locations of the applicator member where it lies at a small distance j from the inside surface 23.

Figure 6E:
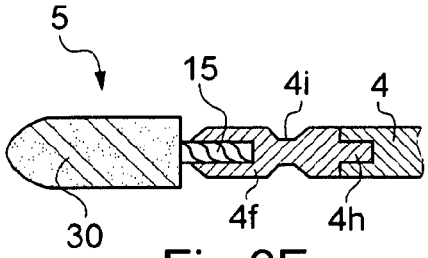

FIG. 6E shows the possibility of making the stem 4 with a flexible portion 4*f*, e.g. adjacent to the applicator member 5, but in a variant it could be situated between two rigid portions of the stem.

The flexible portion 4*f* may be made of an elastomer material and is for example made with a constriction 4*i* that gives it greater flexibility. The flexible portion 4*f* may include a housing for receiving the core 15 of the applicator member and may include fastener means for fastening to the rigid portion of the stem 4, e.g. an endpiece 4*h* that engages in a corresponding housing in the rigid portion of the stem, being held therein for example by snap-fastening, by friction, by stapling, or by stamping the rigid portion of the stem, amongst other fastening options.

The flexible portion of the stem may also be overmolded on the rigid portion of the stem, or vice versa.

FIG. 6E shows an applicator member 5 that presents at least one preferential passage in the form of a helical groove formed between sheets of bristles.

Figure 6F:
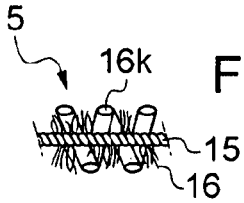

FIG. 6F shows the possibility of making the applicator member with a spring 16*k* mounted on a twisted-core brush 15. The spring 16*k* and/or the bristles 16 may come close to the inside surface of the container.

Figure 6G:
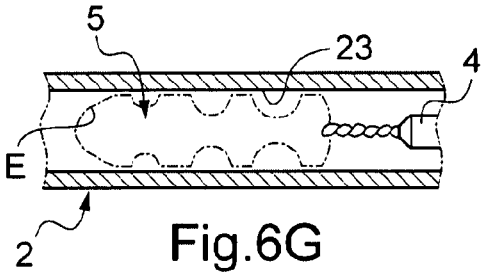

FIG. 6G shows an example of a brush that presents an undulating envelope surface.

Figure 6H:
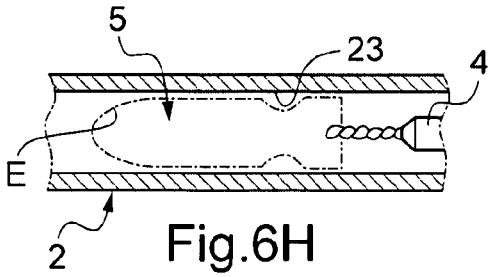
Figure 25:
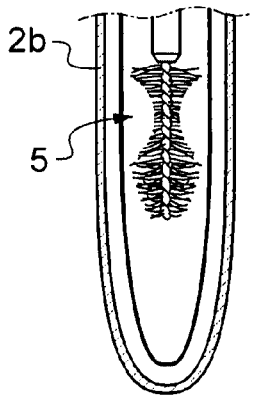
FIG. 25 shows a variant embodiment of the brush.

The envelope surface E may also be fish-shaped, as shown in FIG. 6H or FIG. 25, with a cross-section that passes through a minimum close to its proximal end.

Figure 6I:
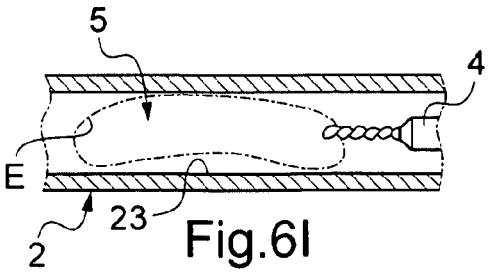

FIG. 6I shows the possibility for the longitudinal axis of the brush to be curvilinear. By way of example, the brush has a bulging side that comes into contact with or close to the inside surface of the container.

Figure 6J:
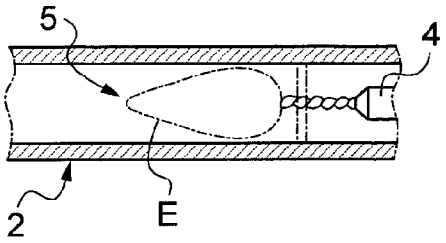

FIG. 6J shows a brush that is provided with a rear annular portion 231 that is contacting the inner surface 23 or close thereto.

Figure 6K:
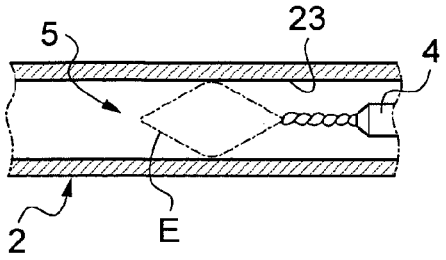

FIG. 6K shows a brush having a biconical envelope surface E.

Figure 6L:
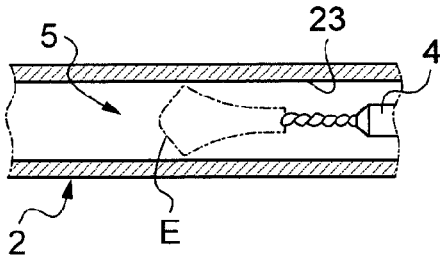
Figure 6M:
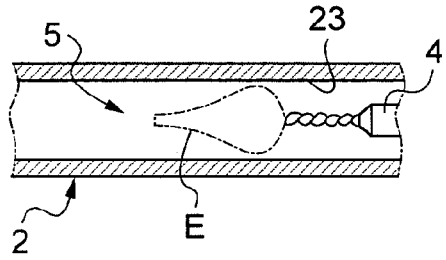

FIG. 6L shows a brush having an envelope surface E which cross-section increases slowly toward the distal end and then decreases sharply.

FIG. 6L shows a brush having an envelope surface E which cross-section increases sharply and then decreases slowly.

Figure 6N:
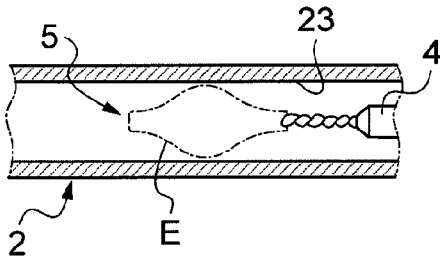

FIG. 6N shows a brush having an envelope surface that is symmetrical about a midplane and decreases toward distal and proximal ends.

Figure 6P:
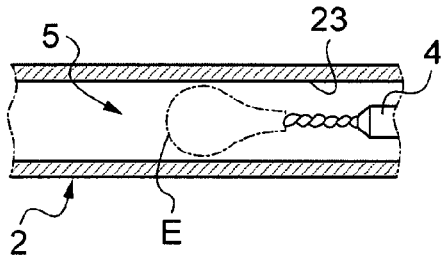

FIG. 6P shows a brush having a spherical distal end, and a cross-section that decreases toward the proximal end.

Figure 6Q:
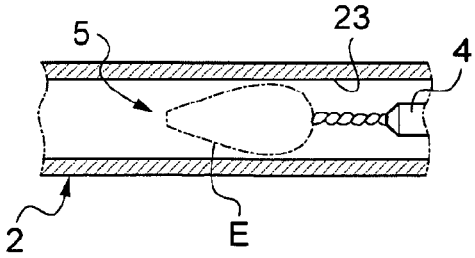

FIG. 6Q shows a brush having an envelope surface that has a spherical proximal end and a cross-section that decreases toward the distal end.

The core 15 of the applicator member may be fastened in various ways to the stem 4. For example, a portion of the core 15 that does not have bristles 16 is inserted by force into a corresponding housing provided at the distal end of the stem 4.

Figure 8A:
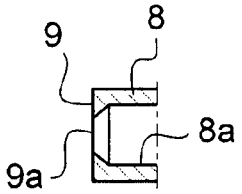
Figure 8B:
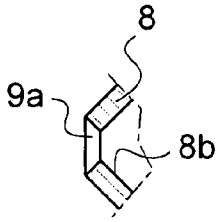
Figure 8C:
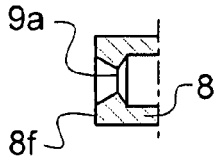
Figure 8D:
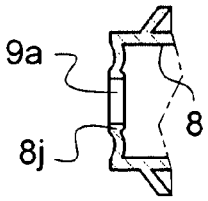
Figure 8E:
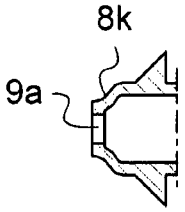
Figure 8F:
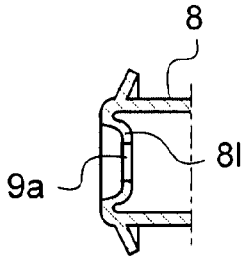

The container 2 may be made with a shape such that in the storage configuration, as shown in FIG. 8F, the distance g between the envelope surface E of the applicator member 5 and the inside surface of the container is greater than the distance k between the envelope surface and the inside surface of the container while the applicator member is being extracted. The distance k may be zero or negative.

The bottom of the container may fit more or less closely to the shape of the applicator member, in particular depending on the residual volume that is acceptable at the end of use of the device.

It would not go beyond the ambit of the present invention for the core 15 to be non-rectilinear, e.g. presenting a curved shape. The distal end of the core 15 need not necessarily be situated on the longitudinal axis of the stem 4.

The applicator member 5 may be stationary relative to the stem 4, as applies for example when the applicator member 5 comprises a twisted core 15 that is fastened in a housing provided at the distal end of the stem 4.

The applicator member 5 may also be made in such a manner as to be capable of turning relative to the handle member 7 and/or the stem 4, e.g. while being extracted from the container and/or when the applicator member 5 comes into contact with the eyelashes.

In the example of FIG. 9, the applicator member 5, which may be any of those described above, is mounted so as to be capable of turning freely about a support pin.

By way of example, the support pin is inserted at one end into a housing in the stem 4 and its other end may comprise a head for retaining the applicator member 5. By way of example, the head is formed by heat sealing performed before or after the pin is put into place on the stem 4. The pin may be made of metal or of thermoplastic material. The pin may also be molded integrally with the stem 4 instead of being fitted thereto.

The applicator may include a vibration source 40, e.g. a source that is fitted to the applicator, as shown in FIG. 9. By way of example, the vibration source 40 includes a contactor 41 that enables its operation to be triggered so that vibration is transmitted to the applicator member 5.

The vibration source 40 is shown in the example of FIG. 9 in association with an applicator member 5 that is capable of turning about the longitudinal axis of the stem, however the vibration source 40 may be mounted on an applicator of the kind shown in FIG. 1 for example, where the applicator member 5 is stationary relative to the stem 4.

By way of example, the vibration source is as described in publication WO 2006/090343 in the name of the Applicant, and the vibration may be in various orientations over a wide range of frequencies.

The applicator member 5 may be connected to the stem 4 via an intermediate element allowing the applicator member 5 a certain amount of freedom to move relative to the stem 4, the intermediate element being constituted, for example, by an elastomer member having a distal portion in which the core of the applicator member 5 is fansted and a proximal portion for fastening in the stem 4, the proximal and distal portions possibly being interconnected by a thin portion that acts as a kind of a hinge about all axes.

Other means may be used to enable the applicator member 5 to move somewhat relative to the stem 4, during application and/or while being extracted from the container.

Figure 7A:
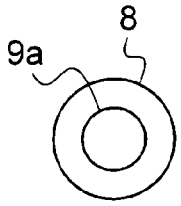
FIGS. 7A to 7F are face views of variant wiper members.

The wiper member 8 may have various forms without going beyond the ambit of the present invention. In particular, the wiper orifice 9*a* may be circular in shape as shown in FIG. 7A, without any slot that opens out into the wiper orifice 9*a*.

Figure 7B:
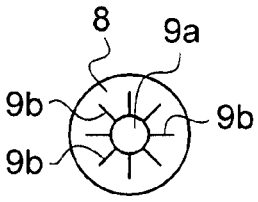

In a variant, as shown in FIG. 7B, the wiper member 8 may be made with slots 9*b* that extend radially, each opening out into the wiper orifice 9*a*, thereby enabling greater deformability to be imparted to the lips of the wiper member.

Figure 7C:
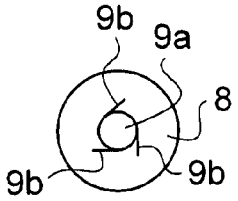

The wiper member 8 may also be made with slots 9*b* that are not radial but that open out tangentially into the wiper orifice 9*a*, as shown in FIG. 7C.

Figure 7D:
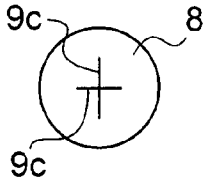
Figure 7E:
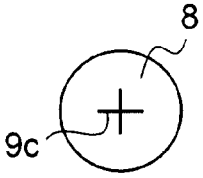
Figure 7F:
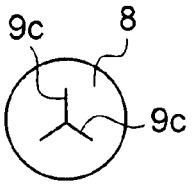

The wiper member 8 need not have a circular wiper orifice, but could merely have one or more slots, as shown in FIGS. 7D to 7F.

In FIG. 7E, the wiper member has a single slot 9*c*, whereas in FIG. 7D it has two slots 9*c* that cross, and in FIG. 7F it has a plurality of slots 9*c* arranged in a star configuration.

The wiper lip may be formed at the end of the wiper member 8, as shown in FIG. 8A, e.g. in the form of a rib projecting radially inwards from a substantially cylindrical wall 8*a* of the wiper member.

The wiper orifice 9*a* may also be formed at the end of a substantially conical wall 8B.b of the wiper member 8, as shown in FIG. 8B.

In the example of FIG. 8C, the wiper orifice 9*a* is formed at a distance from the distal end 8*f* of the wiper member.

In the example of FIG. 8D, the wiper orifice 9*a* is formed through a wall 8*j* of undulating shape capable of deploying when the applicator member 5 passes therethrough. The wiper orifice is defined by the edge of the undulating wall, which edge does not lie in a plane because of its undulating shape. It may be advantageous to use a wiper member with an undulating lip, since, given the ability of the lip to deploy, that makes it easier to pass an applicator member of large diameter.

In the example of FIG. 8E, the wiper orifice 9*a* is defined by a wall 8*k* that is generally convex towards the inside of the container.

In the example of FIG. 8F, the wiper orifice 9*a* is formed through a wall 8*l* that is generally convex towards the inside of the container.

Figure 8G:
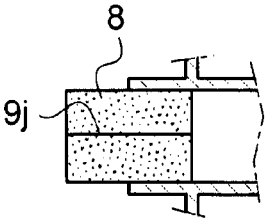

In the example of FIG. 8G, the wiper member 8 is formed by a block of foam pierced by at least one slot 9*j*, for example.

The wiper member 8 may be made as shown in FIG. 8K with a lip that comes into contact with the stem 4 over a relatively long length $L_c$ so as to provide the applicator with a certain amount of guidance. By way of example, the lip is substantially cylindrical in shape or slightly conical, diverging towards the outside of the container, on the same axis as the longitudinal axis of the container. By way of example, the length $L_c$ may lie in the range 2 mm to 5 mm.

Figure 8I:
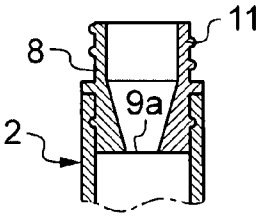

The wiper member 8 may also be fitted on the body of the container so as to constitute the neck thereof, as shown in FIG. 8I.

It is also possible to use an adjustable wiper member, e.g. as described in publications US 2006/0233588 or US 2007/0079845, or a wiper member having two wiper lips.

The container 2 may present a neck of section that is enlarged relative to the body of the container, so that the wiper member presents an inside surface that lies at substantially the same distance from the longitudinal axis of the container as the inside surface of its side wall, as shown in FIG. 8H.

As shown in FIG. 8M, the wiper member may also be made as at least two parts, e.g. a first part 8*d* fitted to the body of the container and possibly forming its neck, and a second part 8*e* that is supported by the first and that defines the wiper member 8. By way of example, the second part 8*e* is made of an elastomer material while the first part 8*d* may be made of a rigid thermoplastic material.

FIG. 8N shows the possibility for the wiper member 8 to be made by molding material monolithically with the body of the container.

FIG. 8O shows a wiper member 8 that is fitted on the neck of the container and that is held thereto, e.g. by friction or by snap-fastening.

The device 1 may be made in such a manner that the applicator member 5 is movable relative to the container 2 between a retracted position as shown in FIG. 10 and an extended position as shown in FIG. 11, without the applicator member 5 being separated from the container 2.

The device 1 may comprise an applicator 3 having, at one end, a driver portion 95 that the user can move relative to the container 2 against the action of a resilient return member 100.

A locking system 105 serves to hold the applicator in its extended position until the user exerts an unlocking action.

By way of example, the locking system 105 comprises a tongue that snaps into a corresponding recess 106 of the container 2. A chamber 110 is defined inside the container 2 for containing the composition P. The container 2 may include a wiper member 8, e.g. molded integrally with the body of the container 2 or constituted by a member that is fitted on the body of the container. A partition 117 separates the chamber 110 from the compartment containing the resilient return member 100, the partition 117 having the stem 4 passed through in leaktight manner.

A closure cap 120 may close the outlet orifice 13 when the applicator member is in its retracted position inside the container 2.

It is possible to use bristles 16 presenting different cross-section shapes without going beyond the ambit of the present invention. All of the bristles of the brush may have the same section, or the brush may have some number of bristles with characteristics that are different, in particular sections that are different.

FIGS. 16A to 16P show examples, amongst others, of possible sections for the bristles 16 of the brush.

The bristles may be of solid circular section as shown in FIG. 16A, of hollow circular section as shown in FIG. 16B, or of non-circular section, e.g. of hollow polygonal section as shown in FIG. 16C, e.g. of triangular hollow section. The bristles 16 may also present a hollow section that is star-shaped as shown in FIG. 16D, a section that is multilobed, which may be solid as shown in FIG. 16E, a flat section as shown in FIG. 16F, an oval section as shown in FIG. 16G, an L-shaped section as shown in FIG. 16H, an H-shaped section as shown in FIG. 16I, a dumbbell-shaped section as shown in FIG. 16J, a solid polygonal section that is triangular as shown in FIG. 16K, square as shown in FIG. 16L, pentagonal as shown in FIG. 16M, semicircular as shown in FIG. 16N, trapezoidal as shown in FIG. 16O, or indeed trough-shaped as shown in FIG. 16P.

The applicator member may be treated with heat in order to curve the bristles and/or in order to form beads at their ends.

The bristles may include particles that are magnetic or magnetizable.

The applicator member may include bristles of different heights.

The bristles of the applicator member may be subjected to grinding.

Where appropriate, and as shown in FIG. 24A, the bristles 16 may cross.

The bristles 16 may be of undulating shape, as shown in FIG. 24B, or of curved shape, as shown in FIG. 24C.

Where appropriate, the inside surface of the container may be provided with splines or fluting as shown in FIGS. 17A to 17C, and 18.

By way of example, the inside surface of the container may include a plurality of longitudinally-extending grooves 23*a* as shown in FIG. 17A, e.g. grooves that are parallel to the longitudinal axis of the container and separated by portions 23*b* of smaller diameter that are situated at a smaller distance from the envelope surface E of the applicator member 5 when it is in the container, and in particular at a distance m that is less than or equal to 1.5 mm, while the distance n between the envelope surface E and the bottoms of the grooves 23*a* is, for example, greater, and in particular is greater than or equal to 2 mm, or even 2.5 mm, or 3 mm.

Each sector 23*b* may extend over a corresponding angular extent $\alpha_i$ around the longitudinal axis of the container, and the sum of all of the angles $\alpha_i$ may be greater than 90°, better greater than 120°, or 180°, or 210°, such that the applicator member stirs the composition in the container in spite of the presence of the grooves 23*a*.

FIG. 17B shows a container having grooves that are more pronounced than in the example of FIG. 17A, and FIG. 17C shows an example with three grooves 23*a* that are separated by sectors 23*b* that are likewise three in number, the sum of the angles $\alpha_1+\alpha_2+\alpha_3$ corresponding to a total angular extent of about 270°.

When a portion of the applicator member is situated close to the inside surface of the container, in particular at a distance of less than 1.5 mm therefrom, over an angular sector of less than 90°, then the movement of the applicator while it is being separated from the container or while it is being returned therein, e.g. as a result of rotation accompanying tightening or loosening the closure cap of the container that also acts as a handle member for the applicator, can cause this portion of the applicator member, which is at a small distance from the inside surface of the container, to sweep angularly over a sector of the inside surface of the container through an angular extent that is greater than 90°.

FIG. 19A shows the possibility of making the container with a wall of varying thickness and with an inside space of constant diameter for receiving the applicator member when it is fastened to the container.

The container may be made as shown in FIG. 19B with an insert 2*a* that defines the inside space containing the composition and a cladding piece 2*b* that defines the outside shape of the container.

The insert 2*a* may be made by molding material to provide a neck 11, in particular a threaded neck, suitable for supporting the wiper member 8.

As shown, the insert may be made with a collar 119 that serves to fasten it in the cladding piece 2*b*, e.g. to snap-fasten it.

The insert 2*a* may have an inside section that is constant over the major fraction of its length, e.g. a circular section. The bottom of the insert 2*a* may be in the shape of a spherical cap.

The applicator member 5 may be hybrid, as shown in FIGS. 22 and 23, i.e. it may be made both with a twisted-core brush and a support 129 of thermoplastic or metal material that is secured to the brush and that serves for example to hold the brush on the applicator.

The support 129 may carry applicator elements 131 molded integrally therewith. For example, the support may have branches 130 that are connected together at their proximal and distal ends, the branches carrying teeth, and the core of the brush may extend between the branches. Hybrid applicator members of this type are described in publication FR 2 916 328.

The teeth may come to within less than 1.5 mm from the inside surface of the container.

Figure 5J:
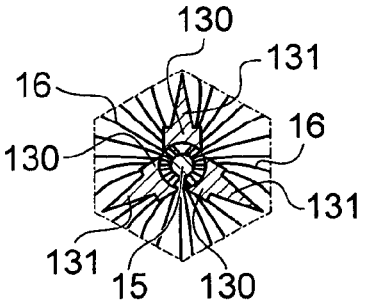

FIG. 5J shows a hybrid applicator member having three branches.

Figure 5K:
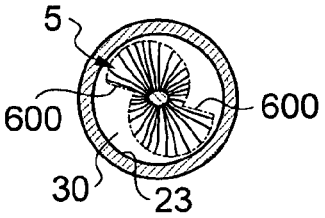

FIG. 5K shows an envelope surface for the brush which in cross-section has facets 600 which are radially oriented. The inner edge of the facets connects progressively to the outer edge of the next facet 600. There may be one or more facets 600.

When the applicator member is hybrid, the brush is made in accordance with the invention with a number of bristles per turn that is as defined above.

The invention is not limited to the examples described above.

The bristles may be flocked.

Figure 4A:
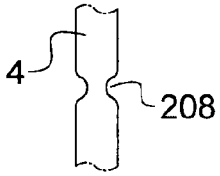
FIGS. 4A and 4B show the possibility of making the stem with at least one constriction.
Figure 4B:
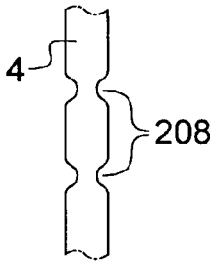

The stem 4 may be made with one or more annular constrictions 208, as shown in FIGS. 4A and 4B. This or these annular constriction(s) 208 may be positioned on the stem so as to be situated in register with the lip of the wiper member when in the storage position so as to avoid stressing it.

The container 2 may be made with a fitted bottom 21, as shown in FIG. 20.

The composition may be of the gel, cream, or "waterproof" solvent type, and it may include waxes and/or polymers. Where appropriate, the composition may be heated prior to being applied.

The features of the embodiments described above may be combined within variants that are not shown. For example, it is possible to associate any one of the above-described wiper members with any of the applicator members of the invention.

The applicator member may comprise any biocidal agent.

In a variant not shown, the brush is a twisted wire brush comprising a plurality of disc shape bristle portions, spaced apart along the longitudinal axis of the core. Each portion comes in contact or close to the inner surface of the container.

The term "comprising a" should be understood as being synonymous with "comprising at least one".

The invention claimed is:

1. A packaging and applicator device for applying a composition on the eyelashes and/or the eyebrows, the device comprising:

a container having a longitudinal axis and defining an inside space containing the composition and including a wiper member; and an applicator comprising a stem carrying an applicator member comprising a twisted-core brush having a core that is rectilinear being situated on the axis of the stem and carrying bristles, there being 5 to 55 bristles per turn and the diameter of the bristles lying in a range of from 6/100 mm to 40/100 mm along at least a portion of the applicator member, a plurality of bristles carried by said portion coming to within a distance of less than 1.5 mm from an inside surface of the container under the wiper member in a storage position or while the applicator is being withdrawn along the longitudinal axis of the container.

2. The device according to claim 1, said portion having 6 to 50 bristles per turn.

3. The device according to claim 1, said portion extending over at least half the length of a portion of the core carrying the bristles.

4. The device according to claim 1, said portion having bristles of diameter lying in a range of from 8/100 mm to 35/100 mm.

5. The device according to claim 1, said portion having an envelope surface that is cylindrical.

6. The device according to claim 1, an inside space of the container being defined by the inside surface, constituting a surface of revolution.

7. The device according to claim 1, said distance being less than or equal to 1 mm.

8. A packaging and applicator device for applying a composition on the eyelashes and/or the eyebrows, the device comprising:

a container having a longitudinal axis and defining an inside space containing the composition and including a wiper member; and an applicator comprising an applicator member comprising a twisted-core brush carrying bristles, there being 5 to 55 bristles per turn and the diameter of the bristles lying in a range of from 6/100 mm to 40/100 mm along at least a portion of the applicator member, wherein when the applicator member is in a storage position, a plurality of bristles carried by said portion come to within a distance of less than 1.5 mm from an inside surface of the container under the wiper member, over an angular sector of at least 90° around the longitudinal axis of the container.

9. The device according to claim 8, the plurality of bristles carried by said portion coming in contact with said inside surface of the container over said angular sector.

10. The device according to claim 8, wherein the plurality of bristles comes to within the distance of less than 1.5 mm from the inside surface of the container under the wiper member, over the angular sector of at least 90° around the longitudinal axis of the container when the applicator member is stationary relative to the container.

11. The device according to claim 1, a height of the inside space of the container, under the wiper member, being greater than or equal to twice the length of the portion of the core that carries bristles.

12. The device according to claim 1, the stem being provided with a flexible portion capable of deforming during withdrawal or return of the applicator from or into the container.

13. The device according to claim 1, the applicator member coming to within less than 1.5 mm from the inside surface of the container when the applicator is in the storage position.

14. The device according to claim 1, a volume of composition contained in the container being greater than 3 mL.

15. The device according to claim 1, the inside surface of the container being invariable.

16. The device according to claim 1, the applicator member including at least two locations that are each situated at less than 1.5 mm from the inside surface of the container, said locations being spaced apart by more than 3 mm along the longitudinal axis of the applicator member.

17. The device according to claim 1, having a majority of bristles that are of the same length.

18. The device according to claim 1 an inside space of the container being defined by a surface of inside section that is polygonal.

19. A packaging and applicator device for applying a composition on the eyelashes and/or the eyebrows, the device comprising:

a container having a longitudinal axis and defining an inside space containing the composition and including a wiper member; and an applicator comprising a stem carrying an applicator member comprising a twisted-core brush, a distal end of the core being situated on the longitudinal axis of the stem, and carrying bristles, there being 5 to 55 bristles per turn and the diameter of the bristles lying in a range of from 6/100 mm to 40/100 mm along at least a portion of the applicator member, a plurality of bristles carried by said portion coming to within a distance of less than 1.5 mm from an inside surface of the container under the wiper member in a storage position or while the applicator is being withdrawn along the longitudinal axis of the container, the maximum cross-section of an envelope surface of the applicator member occupying at least 70% of an inside section of the container.

20. The device according to claim 1, wherein an entirety of the core is rectilinear being situated on the axis of the stem.

* * * * *